United States Patent [19]

Schuessler et al.

[11] 4,286,244

[45] Aug. 25, 1981

[54] ELECTROMAGNETIC ACTUATOR FOR A LATCH RELAY

[75] Inventors: John C. Schuessler, West Covina; David J. Tapp, Manhattan Beach, both of Calif.

[73] Assignee: Leach Corporation, Los Angeles, Calif.

[21] Appl. No.: 126,111

[22] Filed: Feb. 29, 1980

[51] Int. Cl.[3] ..... H01F 7/08

[52] U.S. Cl. ..... 335/230; 335/234

[58] Field of Search ..... 335/79, 80, 85, 229, 335/230, 234

[56] References Cited

U.S. PATENT DOCUMENTS

| | | | |
|---|---|---|---|
| 2,941,130 | 6/1960 | Fischer et al. | 335/230 |
| 3,317,871 | 5/1967 | Adams | 335/230 |
| 3,621,419 | 11/1971 | Adams | 335/230 |
| 3,968,470 | 7/1976 | Brown | 335/230 |

*Primary Examiner*—George Harris

*Attorney, Agent, or Firm*—Christie, Parker & Hale

[57] ABSTRACT

A polarized relay in which the poles of an electromagnet project toward an armature on either side of a pivot support which allows the armature to pivot toward one pole or the other. A pair of permanent magnets each share one pole respectively with the poles of the electromagnet. The other pole of each permanent magnet has a surface extending on either side of the shared pole so as to have a portion closer to the pivot and a portion further away from the pivot relative to the shared pole.

8 Claims, 3 Drawing Figures

ELECTROMAGNETIC ACTUATOR FOR A LATCH RELAY

FIELD OF THE INVENTION

This invention relates to latch type relays, and more particularly, to relays which are polarized to lock the relay in either of its two stable positions by permanent magnets.

BACKGROUND OF THE INVENTION

Latch relays utilizing permanent magnets to lock the relay in either of its two stable positions are well known. See, for example, U.S. Pat. Nos. 2,941,130 and 3,621,419. The latter patent was an attempt to achieve a stronger latching force than could be obtained by earlier designs. This was done by positioning each end of the armature in a gap between the poles of a pair of permanent magnets. However, this design is difficult to implement in a relay where weight and space are at a premium, as in high performance relays used by the aerospace industry. Permanent magnets have also been used in a non-latching relay to hold the relay in the normally open position. U.S. Pat. No. 4,134,090 by the same inventor as the present application shows such a relay.

SUMMARY OF THE INVENTION

The present invention is directed to an improved actuator for a latch relay that utilizes permanent magnets to hold the relay in either of two latch positions. The present design achieves greater latching force with its benefit of higher contact pressure while reducing the energy required to actuate the relay. At the same time, the relay of the present invention provides a more compact design, thereby allowing a smaller and lighter relay to switch higher currents using less input energy.

This is achieved, in brief, by providing an electromagnet having spaced parallel pole members that project toward an armature pivoted at its center between the pole members. Two permanent magnets are positioned adjacent the pole members so that each pole member also serves as one pole of the respective permanent magnets. The other pole of each permanent magnet projects toward the armature and forms a pole face adjacent the armature which extends toward the pivot from a position further from the pivot to a position closer to the pivot than the face of the shared pole members.

DESCRIPTION OF THE DRAWINGS

For a better understanding of the invention reference should be made to the accompanying drawing wherein.

DETAILED DESCRIPTION

Figure 1:
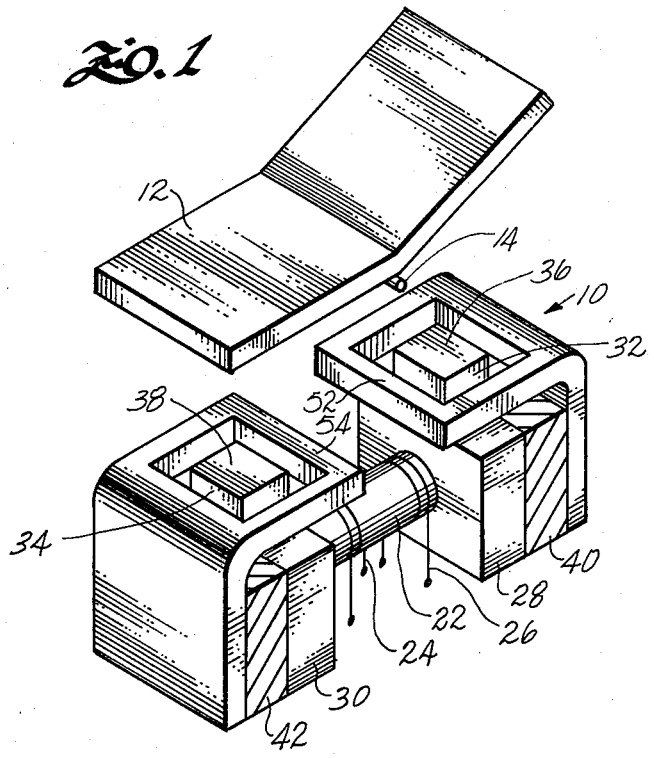
FIG. 1 is a simplified perspective view of the relay actuator of the present invention.
Figure 2:
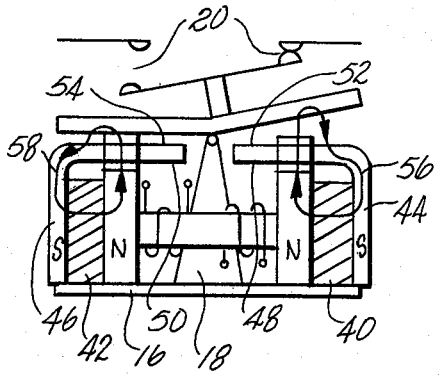
FIG. 2 is a side elevational view of the relay actuator in a de-energized condition.
Figure 3:
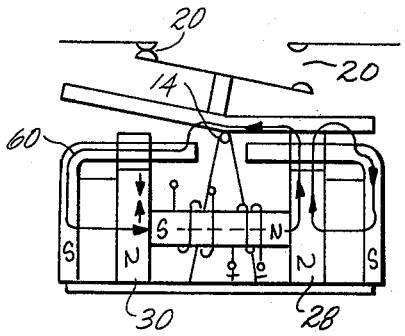
FIG. 3 is a side elevational view of the relay in the energized condition.

Referring to the drawings in detail, the numeral 10 indicates generally the magnetic actuator of a relay which includes an armature 12. The armature 12 is pivoted for rotation about an axis 14. As shown in FIGS. 2 and 3, the axis 14 may be supported in any suitable manner as part of the actuator assembly, as by means of a non-magnetic frame including a base 16 and pivot supporting flanges 18. Relay contacts 20 are operated by rotation of the armature 12 in conventional manner. As shown in FIGS. 2 and 3, the actuator can rotate the armature between two positions in which one set of the contacts are closed and the other set of the contacts are open. It will be noted that the armature 12 in FIG. 1 has been shown in an offset position to expose details of the construction of the actuator.

The relay actuator includes an electromagnet having a core 22 on which is wound a pair of coils, shown schematically at 24 and 26. The core 22 terminates at each end in a pair of pole members 28 and 30, the pole members have projecting portions 32 and 34 which terminate in transverse pole face 36 and 38 respectively. The pole faces are positioned on either side of the pivot axis 14. The armature is bent slightly at the pivot axis so that as it rotates, one end or the other of the armature comes in contact respectively with the pole face 36 or the pole face 38.

A pair of permanent magnets 40 and 42, in the form of blocks are secured to the outer surfaces of the pole members 28 and 30 respectively. The permanent magnets are provided with outer pole members 44 and 46 which are substantially L-shaped, providing a leg portion which projects inwardly toward the pivot. The inwardly directed portions, indicated at 48 and 50 respectively, have openings therein through which the portions 32 and 34 of the pole members 28 and 30 project. The leg portions 48 and 50 of the outer pole members 44 and 46 provide pole faces 52 and 54 which lie adjacent the armature 12.

The armature is normally held in one position or the other by the respective permanent magnets 40 and 42. Thus as shown in FIG. 2, the armature is held against the pole face 38 by the magnet 42 which is polarized to provide flux which extends along the path in the direction indicated by the arrow 58. The permanent magnet 40 is similarly provides flux which extends in the direction of the arrow 56. However, because the armature is in contact with the pole face 38, substantially more flux passes through the armature and therefore produces a substantially greater force on the left end of the armature than is produced on the other end of the armature by the permanent magnet 40.

When the electromagnet is energized by passing a direct current through the coil 24 in a direction to polarize the electromagnet in the direction indicated in the FIG. 3, the flux induced by the electromagnet follows the path indicated by the arrow 60. It will be noted that this flux is added to the flux of the permanent magnet 40 in the pole member 28 thus greatly increasing the force exerted on the righthand end of the armature. At the other end of the armature, the flux of the permanent magnet is opposed by the flux of the electromagnet so that the flux at the face 34 is neutralized. The force exerted by the permanent magnet 42 on the left hand of the armature is therefore reduced by energizing the electromagnet. The flux produced by the electromagnet bridges the relatively small gap between the pole face 54 and the armature 12 immediately adjacent to pivot 14 where it has minimum effect on the left hand end of the armature 12. The net result of the action of the electromagnet is to produce a strong torque on the armature 12 rotating it from the position shown in FIG. 2 into the position shown in FIG. 3. Once rotated into this position, the armature is locked in position by the permanent magnet 40 after the electromagnet is de-energized.

By subsequently energizing the coil 26 of the electromagnet so as to induce flux in the opposite direction from that shown in FIG. 3, the armature is rotated back to its initial position shown in FIG. 2. It will be appreciated that while two coils or windings have been shown for the electromagnet which are selectively energized to reverse the relay, a single coil can be used with the direction of current reversed to switch the latch relay from one latch position to the other.

From the above description it will be seen that a latch type relay is provided in which a pair of permanent magnets act to lock the relay in one or the other of its two stable operating positions. By energizing the electromagnet so as to polarize it in one direction or the other, the relay can be switched from one stable position to the other. The magnetic circuit, which employs principles similar to that described in connection with the non-latch relay described in U.S. Pat. No. 4,134,090 by the same inventor as the present application, permits a relatively weak electromagnet to switch the armature yet providing strong locking action.

What is claimed is:

1. A latch relay comprising:

an electromagnet having a pair of spaced pole members, an elongated armature, means pivotally supporting the armature for angular movement about a central axis, the pole members of the electromagnet projecting toward the armature respectively on either side of the pivot axis, whereby rotation of the armature moves one end of the armature toward one pole member and away from the other pole member, and first and second permanent magnets each having a pair of spaced pole members, one of the pole members of each of the permanent magnets being common with respective pole member of the electromagnet, the other pole member of each of the permanent magnets having a first portion projecting toward the armature adjacent the end of the armature and a second portion extending perpendicular to the first portion toward the pivot axis, the second portion of said other pole member of both permanent magnets having an opening therein through which said one pole member of the permanent magnet projects.

2. The apparatus of claim 1 wherein the permanent magnets are polarized such that said one of the poles of both permanent magnets have the same magnetic polarity.

3. The relay of claim 1 wherein the armature, when rotated, moves into engagement with the one or the other of the pole members common to the electromagnet.

4. The relay of claim 3 wherein said portion of said permanent magnets extends substantially parallel to but spaced slightly from the end of the armature engaged with the common pole member of the same permanent magnet.

5. The relay of claim 2 wherein the armature, when rotated, moves into engagement with the one or the other of the pole members common to the electromagnet.

6. The relay of claim 5 wherein said portion of said permanent magnets extends substantially parallel to but spaced slightly from the end of the armature engaged with the common pole member of the same permanent magnet.

7. A latch relay comprising:

an electromagnet inducting a core, winding means on the core, and a pair of pole members extending from either end of the core, the pole members terminating in pole faces lying in a common plane, a bar-shaped armature, means pivotally supporting the armature relative to the electromagnet for rotation about an axis intermediate the said pole faces, the armature rotating about said axis away from one and toward the other of the respective pole faces, first and second permanent magnets, each permanent magnet engaging a pole member of the electromagnet and permanently polarizing said pole member, and an L-shaped pole member having one leg engaging the block on the opposite side from the electromagnet pole member and having the other leg extending parallel to said common plane toward the pivot axis, said other leg having an opening through which the associated pole of the electromagnet projects towards the armature.

8. The apparatus of claim 7 wherein the permanent magnets are polarized such that the poles of the electromagnet are magnetically the same polarity when the electromagnet is not energized.

* * * * *